United States Patent [19]

Ueshima et al.

[11] Patent Number: 4,809,765

[45] Date of Patent: Mar. 7, 1989

[54] METHOD FOR CONTROLLING SOLIDIFICATION SEGREGATION OF STEEL

[75] Inventors: Yoshiyuki Ueshima; Shozo Mizoguchi, both of Kawasaki; Nobuyuki Komatsu, Kimitsu, all of Japan

[73] Assignee: Nippon Steel Corporation, Tokyo, Japan

[21] Appl. No.: 201,370

[22] Filed: May 27, 1988

Related U.S. Application Data

[63] Continuation of Ser. No. 813,652, Dec. 26, 1985, abandoned.

[30] Foreign Application Priority Data

Dec. 28, 1984 [JP] Japan ..... 59-274351
Dec. 28, 1984 [JP] Japan ..... 59-274352

[51] Int. Cl.[4] ..... B22D 11/22

[52] U.S. Cl. ..... 164/122.1; 164/485; 148/3

[58] Field of Search ..... 164/122, 486, 487, 444, 164/122.1, 485; 148/2, 3

[56] References Cited

U.S. PATENT DOCUMENTS 3,771,584 11/1973 Wojcik ..... 164/486
4,531,974 7/1985 Kos ..... 148/3

FOREIGN PATENT DOCUMENTS 85300700.3 2/1985 European Pat. Off. ..... 164/486
49-6974 2/1974 Japan ..... 164/486
197712 12/1977 Japan ..... 164/444
4224 1/1979 Japan ..... 164/122
55-84203 6/1980 Japan ..... 164/486
55-109503 8/1980 Japan ..... 164/486
55-110724 8/1980 Japan ..... 164/486
5615 2/1981 Japan ..... 164/122
130759 8/1982 Japan ..... 164/122
56453 4/1985 Japan ..... 164/486

OTHER PUBLICATIONS

Metals Handbook Ninth Edition, vol. 1, pp. 114, 115, 183, 188, 189, 414, and 415, 1978.

Koreaki Suzuki et al., "Macrosegregation in Large Steel Ingots", Nippon Seikosho Technical Report, 40 (1980) p. 1–11.

*Primary Examiner*—Nicholas P. Godici
*Assistant Examiner*—Samuel M. Heinrich

[57] ABSTRACT

In a method for controlling solidification segregation in casting of carbon steel containing 0.53 wt. % or less of carbon, α-phase stabilizing elements and γ-phase stabilizing elements of the carbon steel are separated from each other at inter-dendritic portions by adding 2 wt. % or less of at least one element selected from the group consisting of Be, Cr, Nb, Sn, Ti, Mo, and V into the molten steel.

11 Claims, 11 Drawing Sheets

LIQUID
20
21
A
B
δ
γ
C
Si
Mn
P
S
HIGH TEMPERATURE (CENTRAL PORTION)
TEMPERATURE
LOW TEMPERATURE (CIRCUMFERENTIAL PORTION)
LONGITUDINAL SECTION
TRANSVERSE SECTION
THE LAST PART OF SOLIDIFICATION

METHOD FOR CONTROLLING SOLIDIFICATION SEGREGATION OF STEEL

This application is a continuation of application Ser. No. 813,652, filed Dec. 26, 1985, now abandoned.

BACKGROUND OF THE INVENTION

1. Field of the Invention

The present invention relates to a method for controlling the solidification segregation of steel, particularly for mitigating the solidification segregation which causes defects in steel products obtained by continuous casting, etc., more particularly for effectively controlling inter-dendritic segregation during the solidification of steel.

2. Description of the Related Art

The segregation of solutes during continuous casting results in formation of surface flaws and cracks of the casting, thereby impairing the qualities of the final product. Mitigation of the solidification segregation has therefore been desired. Known methods for mitigating the segregation includes: adding calcium into the molten steel; preliminarily decreasing, by refining of the molten steel, the amount of solute elements which cause detrimental segregation; and lessening the roll-distance of a continuous casting machine to suppress the bulging of a casting and electromagnetically stirring the melt to mitigate the central segregation.

From the viewpoints of saving energy and labor, however, either direct rolling or hot-charge rolling is preferable.

In direct rolling, the casting is not allowed to cool down to room temperature, but is rolled directly after the continuous casting. In hot-charge rolling, the casting is charged in a heating furnace before cooling to room temperature and is then rolled.

Japanese Unexamined Patent Publication (Kokai) No. 55-84203 proposes a method for suppressing the surface cracks in direct rolling and hot-charge rolling. The method proposed by this publication involves subjecting the casting, after its melting and solidification (the primary cooling), to ultraslow cooling during a secondary cooling stage until the initiation of the hot-rolling.

This publication threw light, by a simulation experiment, on a particular temperature range of from 1300° C. to 900° C. wherein elements, such as phosphorus, sulfur, oxygen, and nitrogen, detrimental to the hot-workability of steels segregate and precipitate as non-metallic inclusions, and drew attention to the fact that surface cracks frequently occur when the percentage of reduction in area of steel materials becomes less than 60%. The method proposed in this publication controls the morphology of the above-mentioned elements precipitated as non-metallic inclusions so as to suppress the hot-cracking of castings.

Japanese Unexamined Patent Publication No. 55-109503 and No. 55-110724 also disclose to slowly cool the continuous castings prior to the hot-rolling and to directly roll them.

Japanese Examined Patent Publication (Kokoku) No. 49-6974 discloses a cooling and heating treatment of a continuously cast strand in which the temperature difference between the surface and central liquid of the castings is kept from becoming excessively great.

SUMMARY OF THE INVENTION

The present inventors noticed that the qualities of castings are not merely impaired by the quantity of solidification segregation but are also detrimentally influenced synergistically by duplicate segregation, in which both $\alpha$-phase stabilizing elements (P, Si, S, Cr, Nb, V, Mo, or the like) and $\gamma$-phase stabilizing elements (C, Mn, Ni, or the like) condense at an identical site. The present inventors also noticed that the solubilities of $\alpha$-phase stabilizing elements in each of the $\delta$- and $\gamma$-phases differed from those of the $\gamma$-phase stabilizing elements.

The present inventors aim to provide a method for effectively separating these solute elements.

The main problem is to prevent a centerline segregation formed by inter-dendritic segregation and an accumulation thereof.

The present invention provides a controlling method particularly effective on inter-dendritic and centerline segregation in the solidification segregation of steel.

An object of the present invention is to lessen the casting segregation, as is apparent from the above description. Accordingly, the cooling rate referred to hereinafter indicates the cooling rate at the ½-thickness of the cast strand.

In accordance with the present invention, there is provided a method for controlling solidification segregation in casting of carbon steel containing 0.53 wt % or less of carbon, wherein $\alpha$-phase stabilizing elements including P and $\gamma$-phase stabilizing elements including Mn of the carbon steel are separated from each other at inter-dendritic portions of the carbon steel, including the steps of adding 0.005 to 2 wt % of at least one $\delta$-phase region expanding element selected from the group consisting of Be, Cr, Nb, Sn, Ti, Mo, and V into the molten steel; then pouring the molten steel into a mold; subsequently initiating solidification of the molten steel in the mold and forming a primary crystal of $\delta$-phase; cooling the steel at a cooling rate of less than 15° C./min down through a coexistence temperature range where the $\delta$-phase and a $\gamma$-phase are formed by one of a peritectic reaction and an $Ar_4$ transformation; and completing the solidification by means of cooling down to a temperature where steel has the single $\gamma$-phase.

In the method according to the present invention, any one or more of the following preferred embodiments are used:

(a) the cooling at a cooling rate of less than 15° C./min in the coexistence temperature range is carried out when the solidification ratio of the cast strand is 85 to 100%. The "solidification ratio" means a sectional area of a solidified portion divided by the entire section of a cast strand according to ordinary technical terminology;

(b) the steel is heated at a first rate and then cooled at a second rate at least one time in a temperature range of at least one of a peritectic reaction and an $Ar_4$ transformation, wherein the first rate is not less than the second rate;

(c) the steel is cooled at a cooling rate of not less than 30° C./min after a termination of at least one of a peritectic reaction and an $Ar_4$ transformation;

(d) the steel has a carbon content of 0.005 to 0.17 wt %, is cooled down to a temperature where the steel has a single $\gamma$-phase, is then heated to the coexistence temperature range, and is then cooled at a cooling rate of less than 15° C./min;

(e) the steel is heated to a temperature in the coexistence temperature range and then held at the temperature for a predetermined time;

(f) the casting is carried out by a continuous casting; and (g) the steel has a carbon content of 0.005 to 0.53 wt %, and the cooling at a cooling rate of less than 15° C./min is carried out in a secondary cooling of continuous casting.

The above-mentioned embodiments (a) to (g) are disclosed in U.S. Ser. No. 700,675 and EPC publication No. 85300700.3 of the same assignee.

DESCRIPTION OF THE PREFERRED EMBODIMENTS

Figure 1:
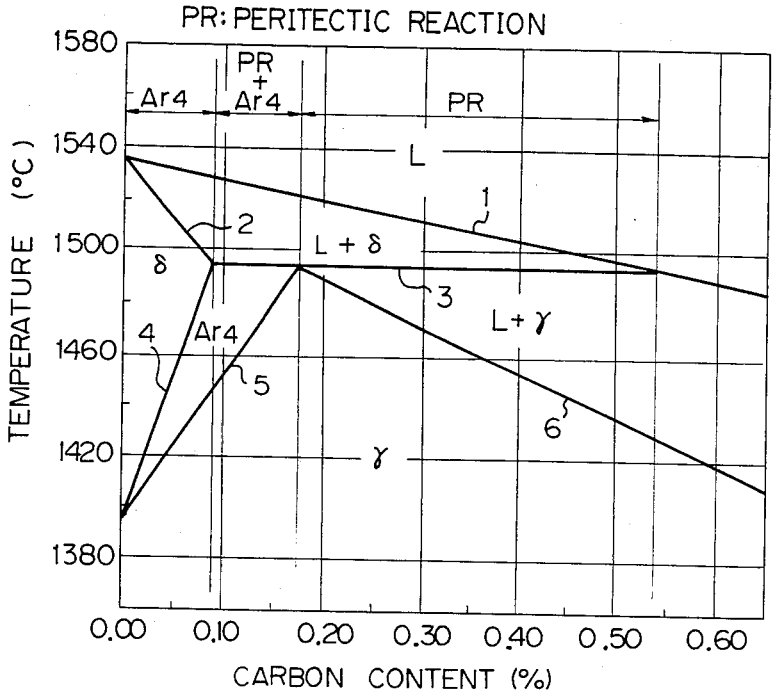
Fig. 1 PRIOR ART
FIG. 1 is a phase diagram of carbon steel.

Referring to FIG. 1, steel having a carbon content of between 0.17 wt % and 0.53 wt % undergoes, during the cooling, a change from the liquid (L) phase (region above the curve 1) to the liquid (L) phase plus the δ-phase, and, a change from the liquid (L) phase plus the δ-phase to the liquid (L) phase plus the γ-phase at 1495° C. (line 3). When the cooling further proceeds, the steel becomes entirely the γ-phase at a temperature below the line 6. By utilizing a so-called peritectic reaction, in which change of the liquid (L) phase and the δ-phase into the liquid (L) phase and the γ-phase occurs at a transformation temperature of 1495° C. and at the interface between the liquid and δ-phases, α-phase stabilizing elements such as P, Si, S, and Cr, especially P and S, are collected in the δ-phase, i.e., the untransformed δ-phase, at a transformation temperature of 1495° C., while γ-phase stabilizing elements such as, C, Mn, Ni, especially Mn, are collected in the γ-phase. When all the phases become γ as a result of further cooling, the α-phase stabilizing elements are collected or segregated in a part of the γ-phase last transformed from the δ-phase. As a result, the segregation sites which exhibit the P concentration peak are separated from those exhibiting the Mn concentration peak and therefore duplicate segregation of P and Mn is avoided.

Steel having a carbon content of 0.005 to 0.08 wt % undergoes, during cooling, successive transformations from the liquid (L) phase, liquid (L) phase plus δ-phase, δ-phase, and γ-phase. The transformation from the δ-phase to the γ-phase is referred to as the $Ar_4$ transformation. The $Ar_4$ transformation begins at the straight line 4 and continues until the straight line 5. By utilizing the coexistence of the δ- and γ-phases during the phase changes of the $Ar_4$ transformation between the straight lines 4 and 5, the α- and γ-phase stabilizing elements are collected into the δ-phase and γ-phase, respectively, in accordance with the solubility difference and are separated from one another. For example, P and Mn move into the δ- and γ-phases, respectively.

When the $Ar_4$ transformation advances further to an extent that the entire steel changes to the γ-phase, the α-phase stabilizing elements are collected in or segregated in a part of the γ-phase last transformed from the δ-phase. As a result, the segregation sites which exhibit the P concentration-peak are separated from those exhibiting the Mn concentration-peak and thus duplicate segregation of P and Mn is avoided.

When steel has a carbon content of 0.08 to 0.17 wt %, both the peritectic reaction and $Ar_4$ transformation can be utilized for separating the α- and γ-phase stabilizing elements from one another.

The δ-phase (=α-phase) region in the phase diagram of FIG. 1 is expanded when one or more of α-phase stabilizing elements Be, Cr, Nb, Sn, Ti, Mo, and V are added to the molten steel.

Figures 2A, 2B, 2C:
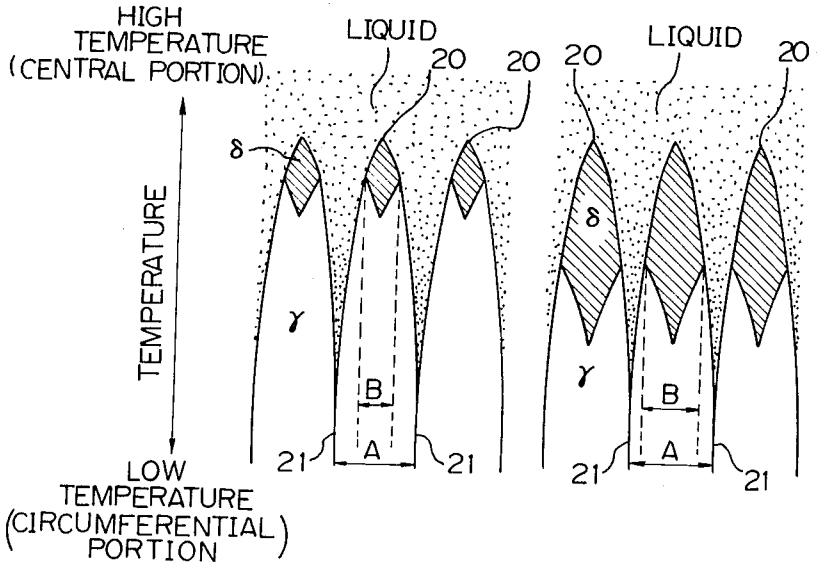
FIGS. 2(a) to (c) are schematic illustrations showing the principle of stabilization of δ-phase in dendrite by means of adding α-phase stabilizing elements and the redistribution of each element between δ-phase and liquid or between δ-and γ-pahses.

Generally speaking, the diffusion rates of impurities or additive elements in solid iron are 10 to 100 times higher in δ-phase than in γ-phase (H. Oikawa, Tetsu to Hagane, 68 (1982) p. 1489). This accelerates the diffusion from segregated high concentration sites to surrounding low concentration sites. Accordingly, when the amount and existence time of the δ-phase is increased in the solidification process of steel, the segregation can be mitigated in accordance with the increased amount and time. Moreover, as shown in FIG. 2, the addition of α-phase stabilizing elements expands the δ-phase region in the dendritic portion and thus the coexistence region where the δ- and γ-phases are contiguous to one another. Consequently, the rate of peritectic reaction and the rate of $Ar_4$ transformation (these two rates hereinafter also collectively referred to as the rate of δ to γ transformation) is increased. The above-mentioned separation of the α-phase stabilizing elements, e.g., P, and the γ-phase stabilizing elements, e.g., Mn, is therefore promoted due to the difference in solubility between the δ- and γ-phases, with the result that duplicate segregation is mitigated at interdendritic portions 21. In FIGS. 2(*a*), (*b*) and (*c*) showing schematically the existence regions of δ-phase and γ-phase in dendrite during the solidification of molten steel, representative segregating elements are present as shown in FIG. 2(*c*). In the case of addition of α-phase stabilizing elements (FIG. 2(*b*) and (*c*)), the coexistence region is expanded compared with the case without additives (FIG. 2(*a*)).

In FIG. 2(*a*) and (*b*), the rate of δ to γ transformation, expressed as $$f_\delta = \left(\frac{B}{A}\right)^2$$

is distinctly increased by the addition of the α-phase stabilizing element(s).

In FIG. 2(*c*), C, Si, Mn, P, and S are shown as the elements of steel dissolved in the liquid phase. Si, P, and S are concentrated in the δ-phase while C and Mn are concentrated in the γ-phase, depending upon the difference in solubility explained above.

The addition of the α-phase stabilizing element promotes the diffusion and separation of P and Mn and thereby mitigates the duplicate segregation as well as reduces the peak value of segregation.

The addition of the α-phase stabilizing element simultaneously mitigates the centerline segregation.

A method is disclosed for controlling an "A" type segregation of large size steel ingots by addition of Mo (Nippon Seikosho Technical Report, 40 (1980) p. 1). In a solid/liquid coexistence layer, the liquid has a lower density than that of liquid bulk, because this layer is rich in solute with lower density. An upward convection current is generated due to the liquid phase having a lower density, with the result that the upward current line of the convection current remains as a streak and causes the formation of the "A" type segregation. The above-mentioned method intends to increase the density of the liquid phase by adding Mo, thereby impeding the upward convection current and the resultant "A" type segregation.

Therefore, the method according to the present invention is distinct from the above-mentioned method in principle.

In the present invention, 0.005 to 2 wt % of one or more of Be, Cr, Nb, Sn, Ti, Mo, and V are added to the molten steel. As the amount of addition exceeds 2 wt %, the effect of mitigating segregation no longer increases so much, while the amount of the nonmetallic inclusion increases. The lowest effective amount of addition is not limited. However, the present inventors observed that an addition of 0.005 wt % is effective. Further, the method according to the present invention is effective when steel has a carbon content of or infinitely close to 0 wt %, e.g., about 0.001 wt %.

The method of addition is not limited. The traditional methods may be used, such as throwing down of ferro alloy, injection method, bullet shooting, and wire addition.

The strength of the above-mentioned separation varies depending on the carbon content of steel and cooling rate. The amount of addition to obtain a certain strength of separation increases as the carbon content and/or cooling rate increase. Therefore, the amount of addition is so preferably determined depending on carbon content of steel and cooling rate that Mnd/Mno is not less than 1 and Pd/Po is not more than 1, where Mnd/Mno and Pd/Po are the values hereinafter, in Example 1, referred to as the degrees of inter-dendritic segregations of Mn and P, respectively.

In the method according to the present invention, the effects of mitigating and separating segregation are further enhanced when steel is slowly cooled at a cooling rate of less than 15° C./min during cooling in the specific temperature range (the embodiment a)). The upper boundary of the specific temperature range is a temperature just below the melting point of steel where the formation of the primary δ-phase begins, while the lower boundary is a temperature at which the $Ar_4$ transformation or peritectic reaction ends, with the result that the steel has a single γ-phase.

The above-mentioned slow cooling in the specific temperature range assists the separation of the α-phase stabilizing elements and the γ-phase stabilizing elements in the steel.

As soon as the steel enters the state of a single γ-phase, the steel is fast cooled at a cooling rate of 30° C./min or more down to about 1000° C. (embodiment c)). This fast cooling helps to keep the segregation peaks separated, as they were separated by the δ to γ transformation, still at ambient temperature (U.S. Ser. No. 700,675 and EPC publication No. 85300700.3).

The separation of α-phase stabilizing elements and γ-phase stabilizing elements proceeds in a quasiisothermal manner in the temperature range of the coexistence region of δ- and γ-phases. Consequently, the separation may be further promoted by reheating the steel from a temperature below and to a temperature in the coexistence region and/or by holding the steel at a temperature in the coexistence region.

EXAMPLE 1

An experiment was carried out in order to simulate the solidification segregation. Steel having a composition of 0.15 wt % C, 0.2 wt % Si, 1.0 wt % Mn, and 0.012 wt % P was solidified in a unidirectional manner. The steel was slowly cooled at a cooling rate of 27° C./min, which is faster than that according to the present invention, during the solidification and down to 1300° C., and then quenched to room temperature. Sections from the thus subjected steel were subjected to two-dimensional analysis by means of an electron-probe microanalyzer (EPMA).

Figure 3:
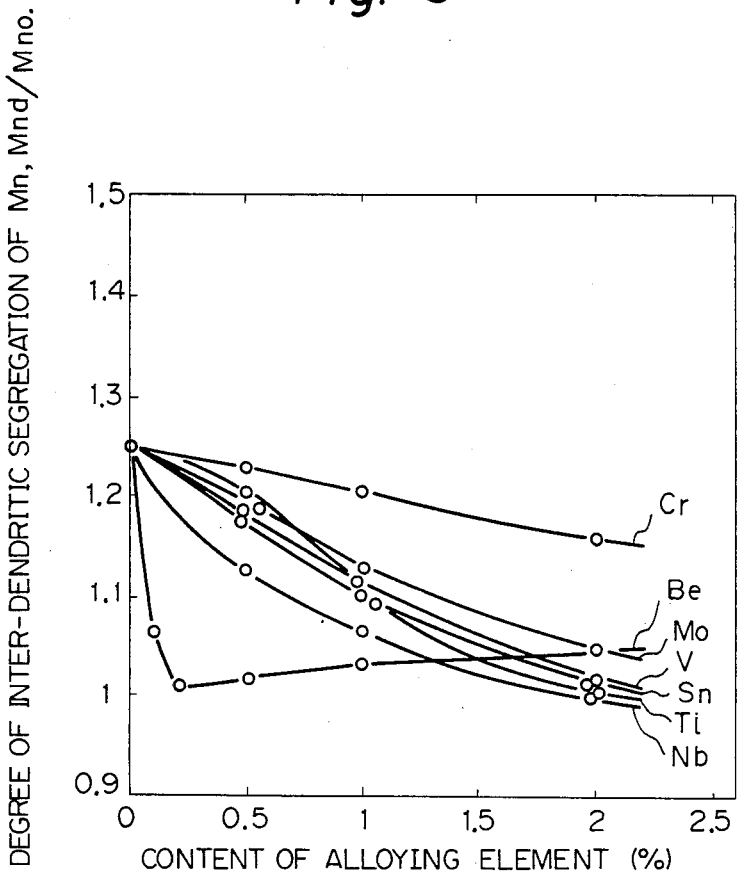
FIGS. 3 and 4 are graphs showing the variation in the degree of inter-dendritic segregation with the addition of alloying elements.
Figure 4:
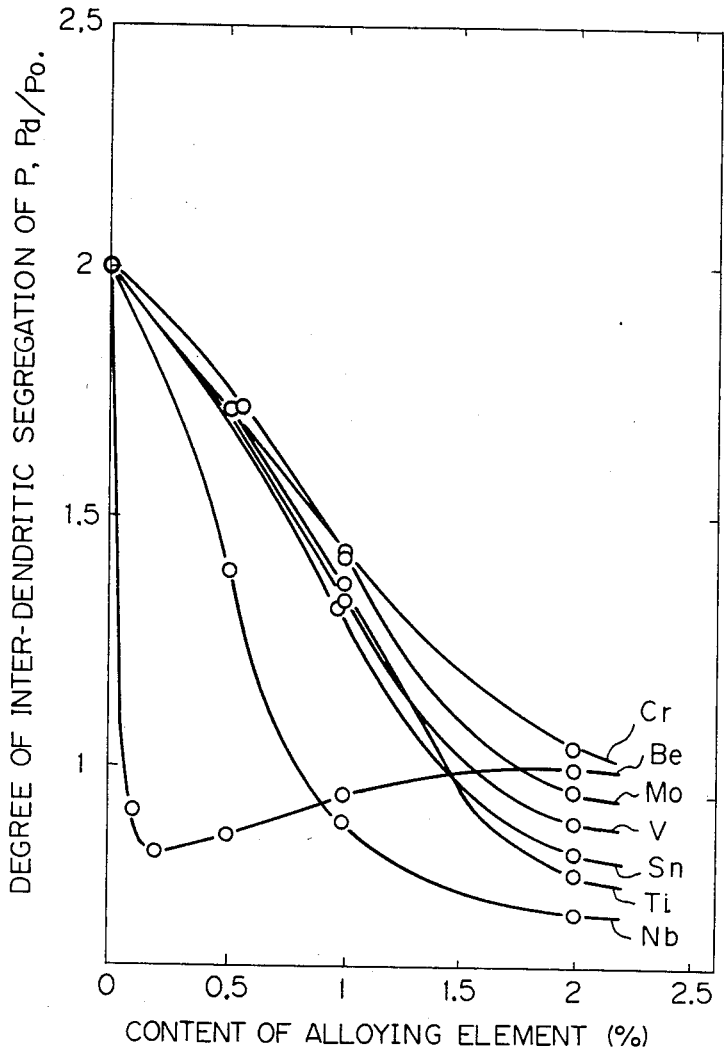

The results thereby obtained are shown in FIGS. 3 and 4, showing the relationships between the contents of alloying elements and the degrees of inter-dendritic segregations of Mn and P, respectively. The degrees of inter-dendritic segregations for Mn and P are indicated by the values of quotients Mnd/Mno and Pd/Po, where Mnd and Pd indicate the concentrations of Mn and P at inter-dendritic sites while Mno and Po indicate the mean concentrations of Mn and P, respectively.

It is obvious that the degree of inter-dendritic segregation of P is largely decreased by the additions of one or more element of the α-phase stabilizing elements Be, Cr, Nb, Sn, Ti, Mo, and V. The additions also effectively reduce the degree of inter-dendritic segregation of Mn, though the reductions are less than those for P. That is, the degrees of inter-dendritic segregation of Mn, though the reductions are less than those for P. That is, the degrees of inter-dendritic segregations of both the α-phase stabilizing element, P, and the γ-phase stabilizing element, Mn, are simultaneously decreased by the addition.

Further, referring to FIGS. 3 and 4, it can be understood that the segregation peaks of Mn and P are perfectly separated where the degree of inter-dendritic segregation of P is lower than 1 and the degree of inter-dendritic segregation of Mn is higher than 1, as for a certain content of a certain alloying element.

EXAMPLE 2

Figure 5:
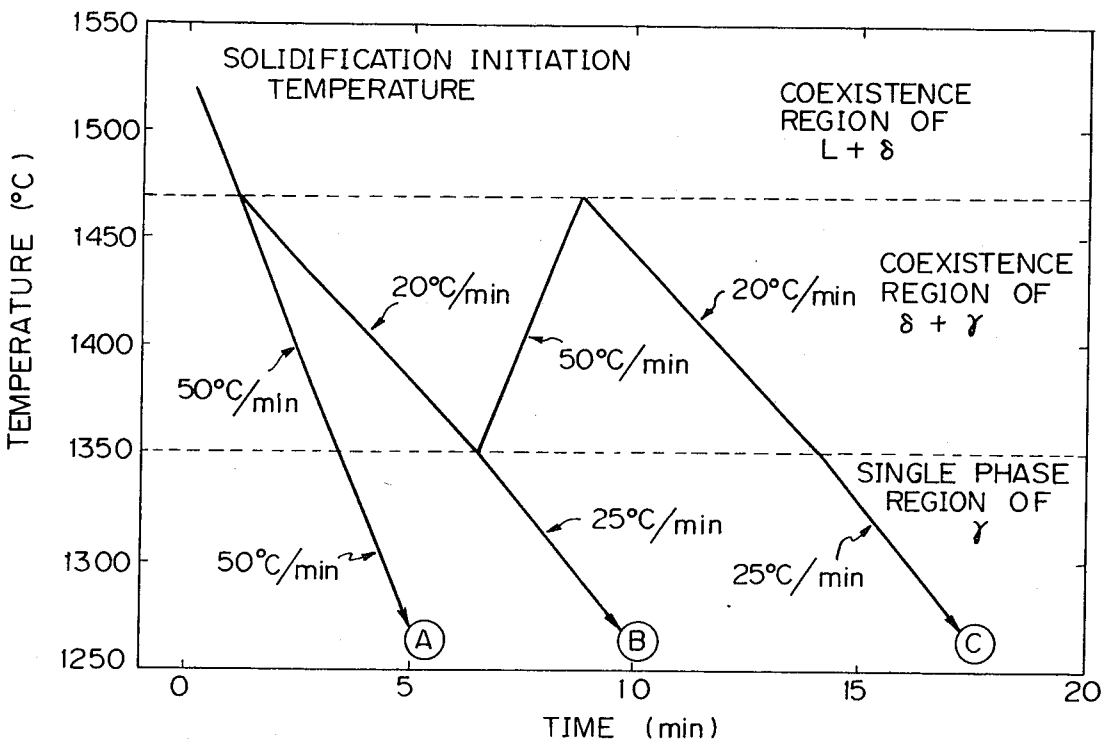
FIGS. 5 and 6 are schematic illustrations of cooling processes.
Figure 6:
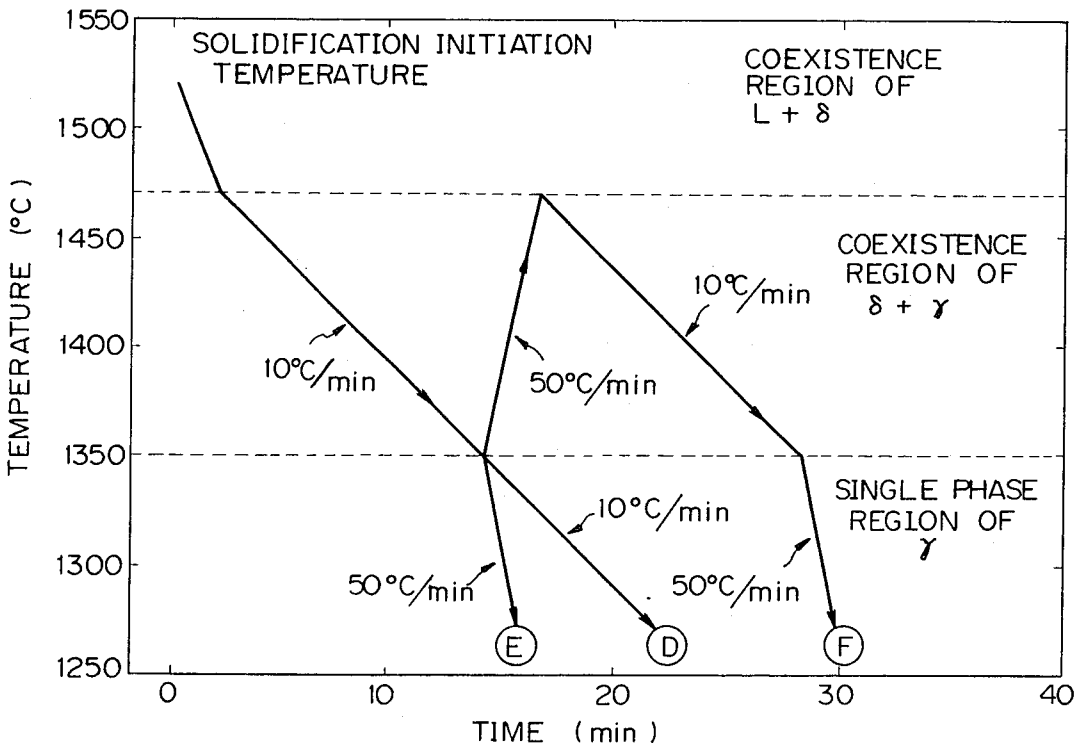

A further experiment was carried out in order to simulate the cooling processes according to the embodiments of the present invention. Steel hvaing a composition of 0.15 wt % C, 0.2 wt % Si, 1.0 wt % Mn, and 0.01 wt % P was solidified in the same unidirectional manner as in Example 1, then cooled through several cooling processes down to a temperature below 1300° C., and then quenched to room temperature. The cooling processes used are schematically shown in FIGS. 5 and 6 and summarized in Table 1. Each of the cooling processes C and F contains an additional heating and cooling step in the temperature range of the coexistence region of δ-and γ-phases, while other cooling processes consist only of cooling steps. Sections from the thus treated steels were subjected to two-dimensional analysis by means of an EPMA.

TABLE 1

| Cooling and Heating Rates in Cooling Process | | |
|---|---|---|
| | Region | |
| Cooling process | δ + γ (≦15)*1 | γ (≧30)*1 |
| | | (°C./min) |
| Comparative Example A | 50 | 50 |
| Comparative Example B | 20 | 25 |
| Comparative Example C | 20 → +50 → 20*2 | 25 |
| Invention D | 10 | 10 |
| Invention E | 10 | 50 |
| Invention F | 10 → +50 → 10*2 | 50 |

*1Preferred range of cooling rate.
*2Each of cooling process C and F consists of cooling, heating, and cooling, in that order, and "+" means heating.

The results thereby obtained are shown in FIGS. 7 to 10, showing the relationship between the cooling processes and the degree of inter-dendritic segregations of P and Mn under the addition of 1% Cr, 1% V, or 0.1% Be, including the case of no addition.

The degrees of inter-dendritic segregations were further mitigated by preferred cooling processes.

Further, the degrees of inter-dendritic segregations were lowered by the addition as for any of the cooling processes.

Figure 7:
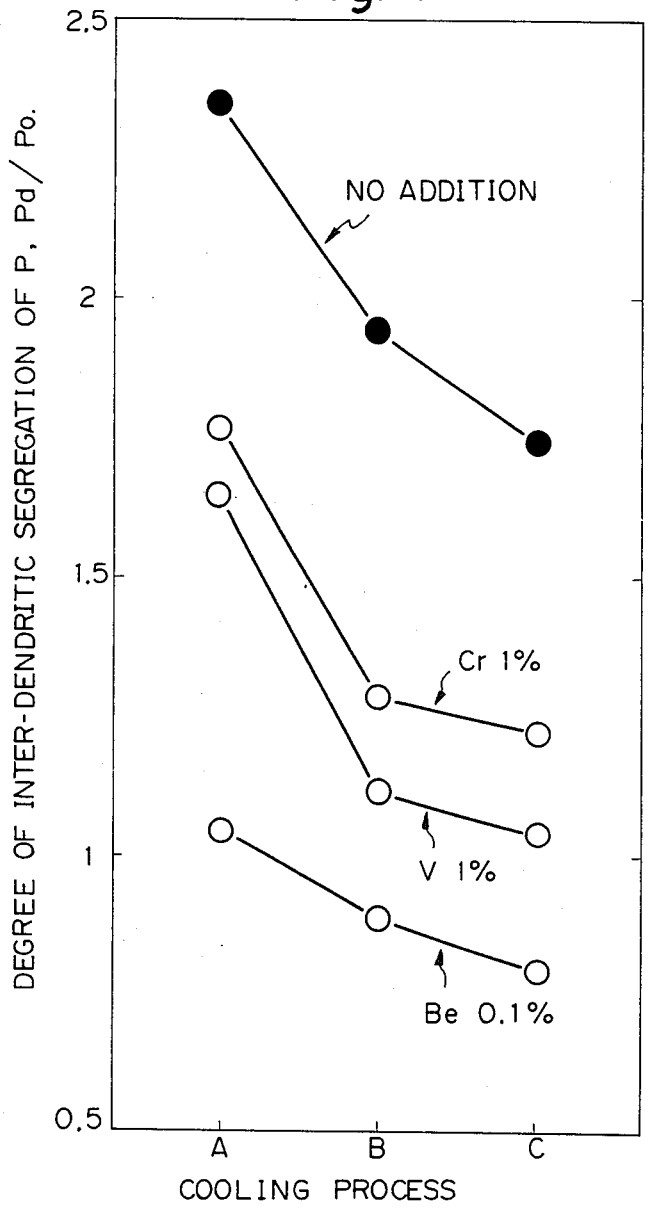
FIGS. 7 and 8 are graphs of the variation in the degrees of inter-dendritic segregations of P and Mn, respectively, with the cooling processes shown in FIG. 5.
Figure 8:
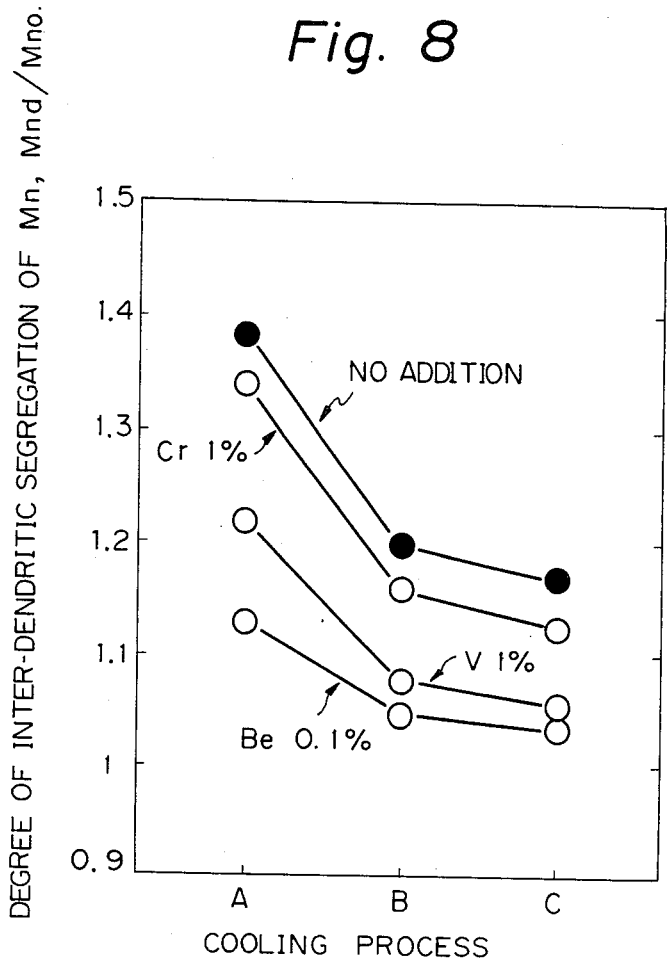

Referring to FIGS. 7 and 8, the degrees of interdendritic segregations of P and Mn are reduced by slow cooling at a cooling rate of 20° C./min in the coexistence region of δ- and γ-phases, e.g., as for process B in comparison with process A.

Figure 9:
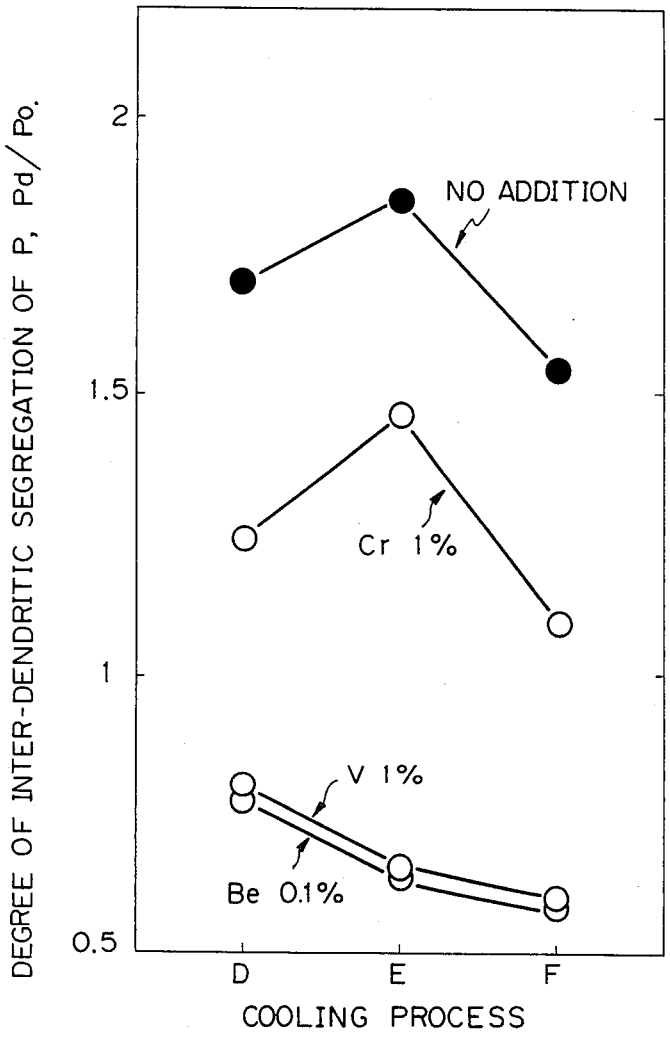
FIGS. 9 and 10 are graphs of the variation in the degrees of inter-dendritic segregations of P and Mn, respectively, with the cooling processes shown in FIG. 6.
Figure 11:
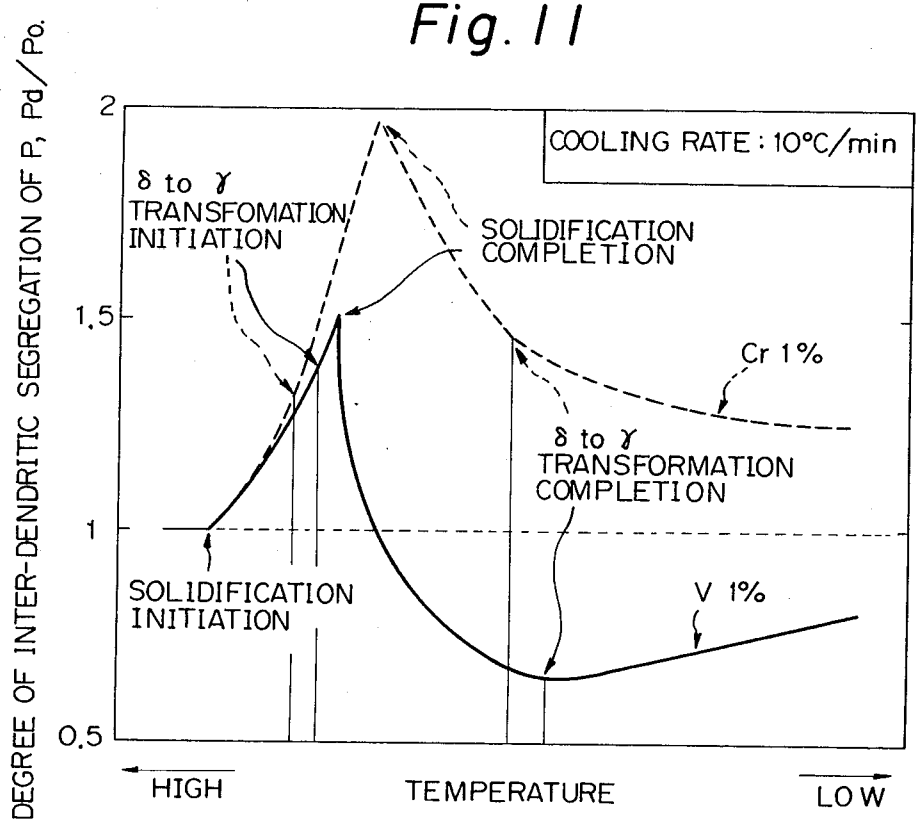
FIG. 11 is a graph showing the variation in the degree of inter-dendritic segregation of P with temperature during solidification and cooling processes.

Referring to FIG. 9, effects of fast cooling at a cooling rate of 50° C./min (higher than 30° C./min) in the region of the single γ-phase are seen from the comparison between processes D and E. As for the addition of V or Be, the degree of inter-dendritic segregation of P is further reduced by the fast cooling. In the case of Cr addition, however, the fast cooling gives an inverse effect. In the case of adding elements having relatively weaker effects on reducing the interdendritic segregation, such as Cr, the degree of interdendritic segregation still exceeds 1 after the completion of the δ to γ transformation, as is shown in FIG. 11 with comparison with the case of V addition. In such a case, diffusion in the solid phase, single γ-phase here, has a relatively predominant effect on homogenization of segregated elements. Therefore, it is preferred to select the combination of additive elements and cooling process in order to optimize the effect on mitigating the inter-dendritic segregation.

Figure 10:
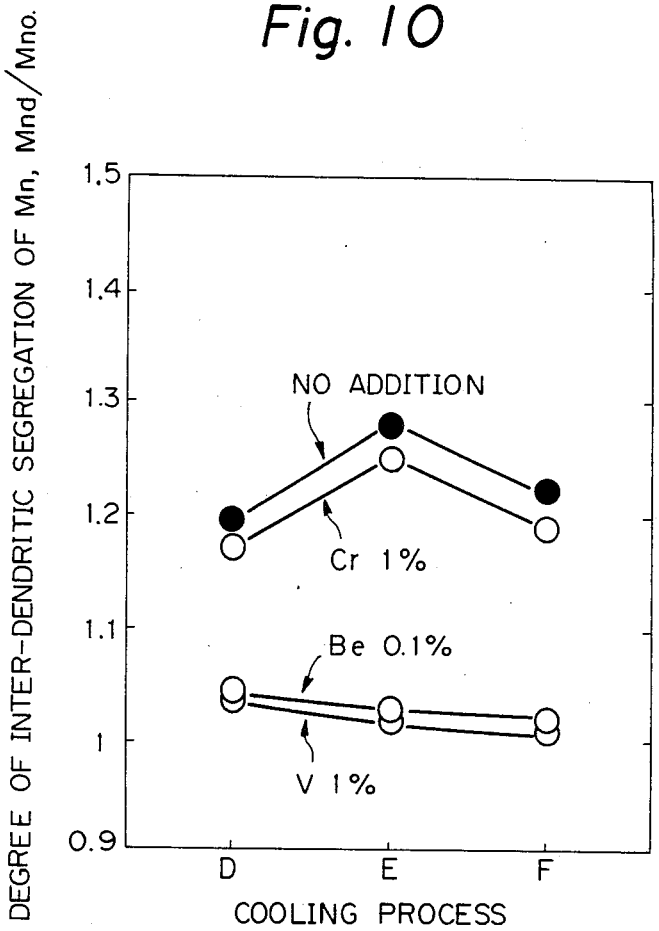

Referring to FIGS. 9 and 10, identical effects are seen for P and Mn, though the effects are less for Mn.

Comparing FIGS. 9 and 10 with FIGS. 7 and 8, both of the degrees of inter-dendritic segregation of P and Mn are apparently lower for the former pair than for the latter pair.

We claim:

1. A method for controlling solidification segregation in casting of carbon steel containing 0.53 wt % or less of carbon, wherein α-phase stabilizing elements including P and γ-phase stabilizing elements including Mn of said carbon steel are separated from each other at inter-dendritic portions of said carbon steel, comprising the steps of:

adding 0.005 to 2 wt % of at least one δ-phase region expanding element selected from the group consisting of Be, Cr, Nb, Sn, Ti, Mo, and V into said molten steel;

pouring said molten steel into a mold;

subsequently, initiating solidification of said molten steel in said mold and forming a primary crystal of δ-phase;

cooling said steel at a cooling rate of less than 15° C./min down through a coexistence temperature range where the δ-phase and a γ-phase are formed by at least one of a peritectic reaction and an $Ar_4$ transformation; and completing the solidification by means of cooling down to a temperature where steel has the single γ-phase.

2. A method according to claim 1, wherein said cooling at a cooling rate of less than 15° C./min in said coexistence temperature range is carried out when the solidification ratio of the cast strand is 85 to 100%.

3. A method according to claim 2, further comprising the steps of heating at a first rate and then cooling at a second rate said steel at least one time in a temperature range of at lesat one of a peritectic reaction and an $Ar_4$ transformation, wherein the first rate is not less than the second rate.

4. A method according to claim 2, wherein said steel is cooled at a cooling rate of not less than 30° C./min after a termination of at least one of a peritectic reaction and an $Ar_4$ transformation.

5. A method according to claim 4, further comprising the steps of heating at a first rate and then cooling at a second rate said steel at least one time in a temperature range of at least one of a peritectic reaction and an $Ar_4$ transformation, wherein the first rate is not less than the second rate.

6. A method according to claim 1, further comprising the steps of heating said steel having a carbon content of 0.005 to 0.17 wt % to said coexistence temperature range after forming said single γ-phase, and then cooling said steel at a cooling rate of less than 15° C./min.

7. A method according to claim 6, further comprising the step of holding said steel at said coexistence temperature range for a predetermined time.

8. A method according to claim 2, further comprising the steps of heating said steel having a carbon content of 0.005 to 0.17 wt % to said coexistence temperature range after forming said single γ-phase, and then cooling said steel at a cooling rate of less than 15° C./min.

9. A method according to claim 8, further comprising the step of holding said steel at said coexistence temperature range for a predetermined time.

10. A method according to claim 2, 3, 4, 5, 6, 7, 8, or 9, wherein said casting is carried out by continuous casting.

11. A method according to claim 10, wherein said steel has a carbon content of 0.005 to 0.53 wt %, and said cooling at a cooling rate of less than 15° C./min is carried out in a secondary cooling of continuous casting.

* * * * *

UNITED STATES PATENT AND TRADEMARK OFFICE

CERTIFICATE OF CORRECTION

PATENT NO. : 4,809,765

DATED : March 7, 1989

INVENTOR(S) : Y. Ueshima, et al.

It is certified that error appears in the above-identified patent and that said Letters Patent is hereby corrected as shown below:

Column 6, lines 44 and 45, please delete these two lines.

Column 8, line 27, change "lesat" to --least--.

Signed and Sealed this

Tenth Day of October, 1989

*Attest:*

DONALD J. QUIGG

*Attesting Officer*

*Commissioner of Patents and Trademarks*